United States Patent [19]

Felter

[11] 4,136,822

[45] Jan. 30, 1979

[54] APPARATUS AND METHODS FOR CONTROLLING FAN OPERATION

[76] Inventor: John V. Felter, P.O. Box 7464, Houston, Tex. 77008

[21] Appl. No.: 817,612

[22] Filed: Jul. 21, 1977

Related U.S. Application Data

[63] Continuation-in-part of Ser. No. 711,738, Aug. 5, 1976, abandoned, which is a continuation-in-part of Ser. No. 597,495, Jul. 21, 1975, abandoned.

[51] Int. Cl.[2] ..... F24F 7/06

[52] U.S. Cl. ..... 236/49; 236/91 G; 98/43 R

[58] Field of Search ..... 236/49, 91 F, 91 G, 236/91 A; 98/43 C, 43 R; 237/1 A; 126/270; 73/346; 219/499; 307/362

[56] References Cited

U.S. PATENT DOCUMENTS

| | | | |
|---|---|---|---|
| 2,362,977 | 11/1944 | Crosthwait et al. | 236/91 G |
| 2,601,028 | 6/1952 | Kersten | 236/49 UX |
| 3,144,991 | 8/1964 | Marchant | 236/91 F X |
| 3,751,635 | 8/1973 | Niehaus | 219/499 |
| 3,998,207 | 12/1976 | Watt | 126/400 X |

FOREIGN PATENT DOCUMENTS

| | | | |
|---|---|---|---|
| 1298203 | 7/1969 | United Kingdom | 236/91 F |

*Primary Examiner*—William E. Wayner
*Attorney, Agent, or Firm*—Carl B. Fox, Jr.

[57] ABSTRACT

Apparatus and methods for controlling fan operation, wherein a temperature difference sensor senses inside and outside temperatures, and actuates switch devices so that fan operation is commenced when the interior temperature exceeds the exterior temperature by a predetermined amount. Fan operation may also be controlled in response to humidity, a humidistat actuating the fan when the humidity exceeds a predetermined level.

3 Claims, 5 Drawing Figures

FAN MOTOR
SUMMER
OFF
WINTER
115v.

APPARATUS AND METHODS FOR CONTROLLING FAN OPERATION

This application is a continuation-in-part of application Ser. No. 711,738, filed Aug. 5, 1976, now abandoned, which in turn was a continuation-in-part of application Ser. No. 597,495, filed July 21, 1975, now abandoned, all applications being by the same applicant.

BACKGROUND OF THE INVENTION

Automatic controls for ventilation equipment are customarily designed to operate the ventilation equipment when the temperature inside of a building exceeds a certain predetermined temperature. When the temperature is below the predetermined level, the ventilation equipment does not operate. When the temperature exceeds the predetermined level, the ventilation equipment is started in operation and its operation continues until the temperature drops to either the predetermined level or to some other control level. Since ventilation can help in cooling a home, building, or other structure whenever the interior temperature exceeds the exterior temperature, it is desirable to have apparatus and methods for automatically causing fan operation whenever the interior temperature exceeds the exterior temperature by just a few degrees. It is also desirable, especially during winter, to control humidity within a home, building, or other structure by ventilation. This invention seeks to solve both the temperature and humidity problems by providing ventilation whenever it is needed in response to relatively elevated inside temperature and in response to excessive interior humidity.

SUMMARY OF THE INVENTION

The invention affords apparatus and methods for controlling the fans or blowers of ventilation equipment in response to a differential between exterior and interior temperatures, and in response to a high interior humidity level. A temperature difference switch is provided which closes to start the ventilation fan or blower in operation whenever the interior temperature exceeds the exterior temperature by a predetermined amount. The apparatus may also include a humidistat switch which closes to commence fan operation whenever the humidity exceeds a predetermined level. In general, the temperature differential switch will be used during summer periods when ventilation for temperature control is primarily necessary, and the humidistat control will be used during winter periods when excessive humidity beneath a roof is likely to occur. Since ventilation will help to control interior temperatures whenever the interior temperature exceeds the exterior temperature, the temperature differential switch is preferably designed or set to commence ventilation fan operation whenever the indoor temperature exceeds the outdoor temperature by a small amount, say by about two degrees Fahrenheit or by about one degree Celcius. The humidistat may be adapted to control ventilator fan operation for any selected interior humidity levels. Normally for comfort it will be desirable to commence ventilator fan operation when the interior relative humidity reaches about 80%, and the ventilator fan operation will preferably be stopped when the interior relative humidity has dropped to about 70%.

A principal object of the invention is to provide apparatus and methods for controlling ventilation fan or blower operation in response to differential interior and exterior temperatures. Another object of the invention is to provide such apparatus and methods which will control fan or blower operation in response to the indoor temperature exceeding the outdoor temperature by a predetermined differential amount. A further object of the invention is to provide such apparatus and methods which will additionally control ventilator operation in response to elevated humidity. Yet another object of the invention is to provide such apparatus and methods which are simple, economical and safe.

Other objects and advantages of the invention will appear from the following detailed description of preferred embodiments, reference being made to the accompanying drawings.

BRIEF DESCRIPTIONS OF THE DRAWINGS

DESCRIPTION OF THE PREFERRED EMBODIMENTS

Figures 1, 3, 4:
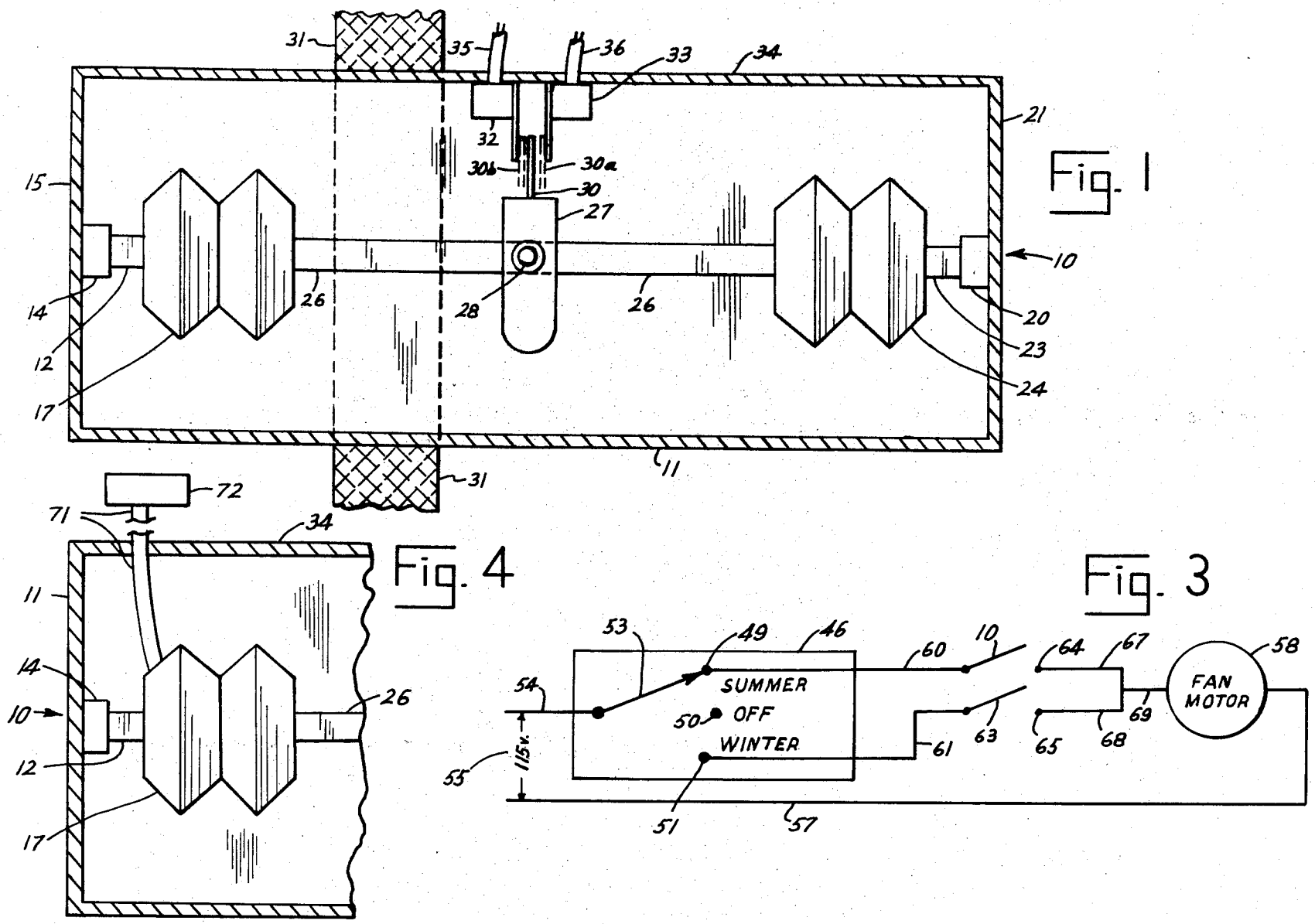
FIG. 1 is a cross section of a temperature differential switch of preferred form according to the invention.
FIG. 3 is a schematic circuit diagram used in connection with the apparatus and methods.
FIG. 4 is a partial cross section showing a modified form of temperature differential switch according to the invention.

Referring now to the drawings in detail, and first to FIG. 1, there is shown a temperature difference sensor or switch 10. The sensing switch apparatus is housed in a housing 11, which may be of any suitable form, and which herein is shown as a simple rectilinear box. A bar 12 extends from a mount 14 affixed to wall 15 of housing 11. A bellows assembly 17 is connected to the inner end of bar 12. At the opposite side or end of housing 11, a mount 20 affixed to wall 21 supports bar 23 to which bellows assembly 24 is connected. A bar 26 is connected between the inner sides of the two bellows assemblies 17, 24. A switch contact support 27 is connected to bar 26 at its center by a bolt or rivet 28 received through a suitable opening through bar 26. Switch contact element 27 has switch contact 30 extending upwardly from its upper end. Housing 11 is disposed through a wall 31 of a building, bellows assembly 17 being outside of the building and bellows assembly 24 being inside of the building.

A pair of switches 32, 33 are affixed to the center of upper wall 24 of housing 11. Electrical conductors 35, 36 extend from switches 32, 33, respectively, to the exterior of the housing.

The bellows assemblies 17, 24, each of which may include a single bellows or a suitable plurality of individual bellows, two being shown, are gas-filled bellows structures which expand in response to increases in temperature and which contract in response to decreases in temperature. When the temperature at inside bellows assembly 24 exceeds the temperature at outside bellows assembly 17, then bellows assembly 24 will be relatively expanded while bellows assembly 17 will be relatively contracted. This will cause movement of contact 30 toward the left to a position **30*b* against the downwardly extending contact of switch 32. On the other hand, if bellows assembly 17 is at a higher temperature than bellows assembly 24, then bellows assembly 17** will be relatively expanded with respect to bellows assembly 24 and contact 30 will be moved toward the right to a position 30a against the downwardly extending contact of switch 33. Since there is some freedom of movement of contact 30 between the downwardly extending switch contacts, the contact 30 may move a certain amount in either direction from center before contact either switch contact. The spacing between the switch contacts determines the temperature differential response of the apparatus. It has been found that a switch contact spacing relative to movements of contact 30 is preferred when the contact 30 movement will start the ventilator fan in operation for a temperature difference, inside over outside, of approximately two to three degrees Fahrenheit, or about one to two degrees Celcius. Say, for example, that bellows assembly 17 is disposed to respond to exterior temperatures and bellows assembly 24 is disposed to respond to interior temperatures as shown in FIG. 1. When the temperature at bellows assembly 24 exceeds that at bellows assembly 17 by two or three degrees Fahrenheit (one or two degrees Celcius), then contact 30 will engage the contact of switch 32 and cause operation of the ventilator fan or blower. When the temperature differential decreases below the specified amount, contact 30 will be moved away from the contact of switch 32 and the fan or blower will be shut off. The switch 33, in this case, will not be used, but is provided so that housing 11 may be installed with either bellows assembly responsive to indoor or outdoor temperatures.

Figure 2:
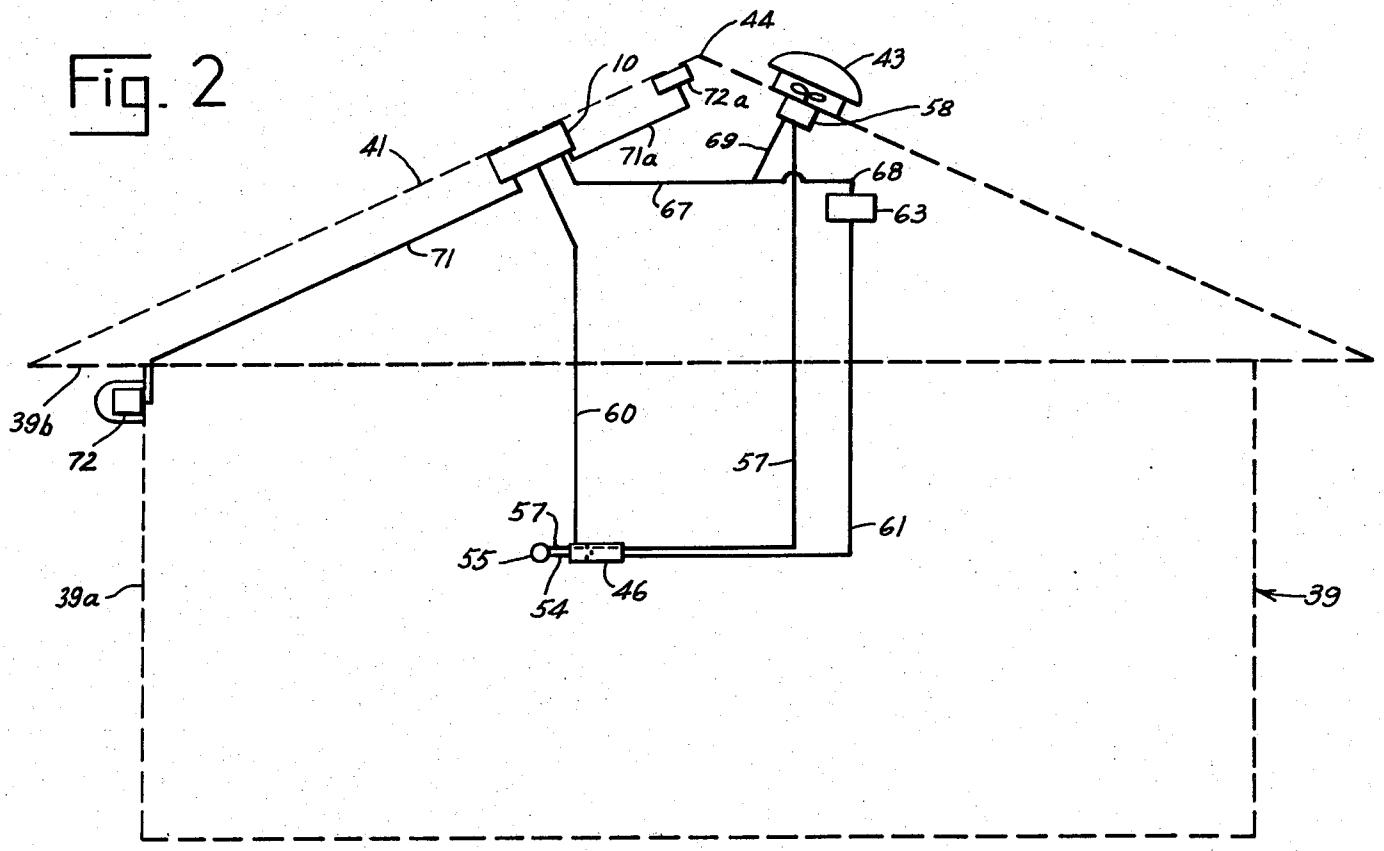
FIG. 2 is a schematic view illustrating the use of the apparatus and methods in a structure.

Referring now to FIG. 2 of the drawings, a home, building or other structure is indicated by reference numeral 39. The temperature difference sensor switch 10 is affixed beneath the roof 41 of building 39 as shown. Switch 10 may be at any place within the attic, and is shown just under roof 41 so that bellows assembly 24 will be in a relatively hot part of the attic.

An electric motor-driven ventilator 43 is mounted on roof 41 adjacent peak 44, that is, at a high point of the roof where the hottest air under the roof will tend to collect. A switch 46 is located in building 39 at a convenient control point.

Switch 46 is shown in more detail in FIG. 3 of the drawings. Three terminals, "SUMMER" 49, "OFF" 50, and "WINTER" 51 are provided, and switch element 53 is movable to any of these three positions. A conductor 54 leads from a suitable power source 55, which may be an ordinary 115 volt circuit, to element 53. Conductor 57 leads from electrical power source 55 to one side of fan motor 58. Parallel conductors 60, 61, respectively extend from "SUMMER" terminal 49 to switch device 10, and from "WINTER" terminal 51 to humidistat switch 63. The terminals 64, 65, respectively, of switches 10 and 63 are connected by conductors 67–69 to the other side of fan or blower motor 58. Fan or blower motor 58 will operate to ventilate the attic or other building area whenever either switch 10 or switch 63 is closed and switch 53 is moved to the corresponding position.

Referring now to FIG. 4 of the drawings, the left hand portion of the switch apparatus shown in FIG. 1 is illustrated in modified form. The right hand portion of the switch apparatus may be similarly modified. An elongate connector element 71 extends from bellows assembly 17 through wall 34 to the exterior of housing 11. A device 72 is connected to the end of connector 71. Elements 71, 72 are shown in FIG. 2. The device 72 is shown mounted through wall 39a of building 39, beneath eave 39b so as to be shaded from direct sunlight.

Elements 71, 72, as shown in FIGS. 2 and 4, act to cause bellows 17 to expand or contract in response to a temperature change at the location of device 72. Device 72 is preferably a non-elastic gas reservoir and connector 71 is a tubular conduit connecting the interior of element 72 with the interior of bellows assembly 17. As stated, bellows assembly 24 may be equipped with a gas reservoir 72a and conduit 71a in the same manner as shown in FIG. 2. Thus equipped, bellows assemblies 17 and 24 will respond to temperatures at reservoirs 72 and 72a, to turn on fan motor 58 when the temperature at reservoir 72a exceeds the temperature at reservoir 72.

Figure 5:
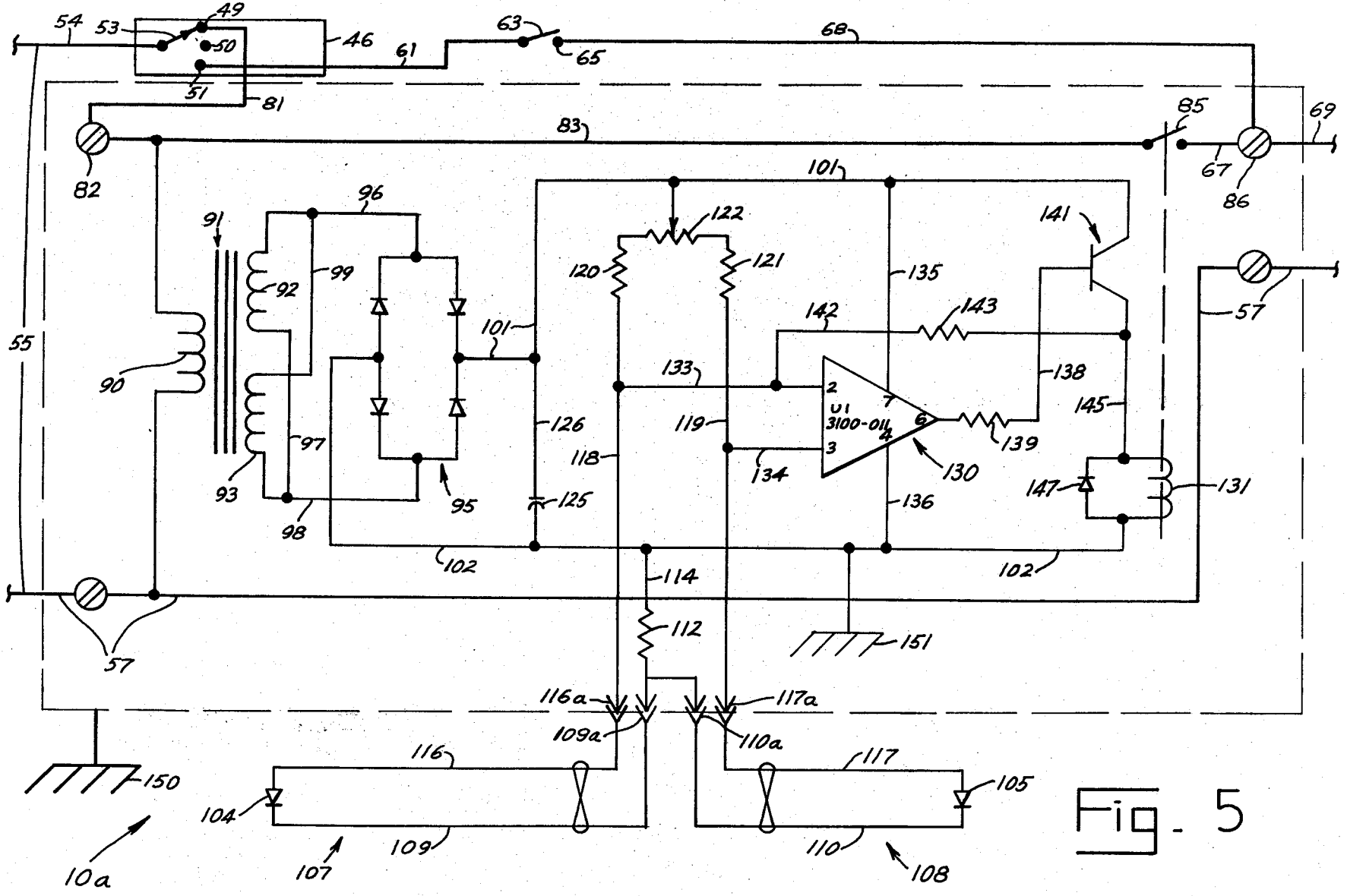
FIG. 5 is an electrical circuit diagram showing a form of temperature sensing switch apparatus useful with the invention.

In FIG. 5 there is shown another form of temperature sensing switch 10a which may be used to replace bellows switch 10. Switch 46 of FIG. 3 is shown in FIG. 5, and performs the same functions as before.

Power source 55 supplies alternating current electrical power to the system at 90–130 volts and at a frequency of 50–60 Hertz, through conductors 54 and 57. Conductor 54 leads to switch 46, and when switch contact 53 is closed at terminal 49 conductor 81 leading to terminal 82 is energized. Conductor 83 extends from terminal 82 to one terminal of a solenoid-actuated switch 85. The other terminal of switch 85 is connected to conductor 67 leading to terminal 86, to which conductors 68 and 69 are connected. Fan motor 58 is energized to operate through conductors 57 and 69, as before when solenoid switch 85 of switch 10a is closed and switch contact 53 is closed at terminal 49 of switch 46.

Primary coil 90 of transformer 91 is connected between conductors 57 and 83 as shown. Secondary coils 92, 93 of the transformer are connected to full wave bridge rectifier 95 by conductors 96–99. The direct current rectifier output is delivered to the remainder of the circuit by conductors 101 and 102.

Sensors 104 and 105, each a diode, are positioned to detect and respond to temperature differences. Sensor 104 is placed at an exterior location, to sense outdoor temperatures, and sensor 105 is placed at an indoor location, for example in an attic, to sense temperatures at that location. Cable assemblies 107, 108 have conductors 109, 110, respectively, which, through plug in connectors 109a, 110a are connected together and to conductor 102 through resistor 112 in conductor 114. Conductors 116, 117 of cable assemblies 107, 108, respectively, are connected through plug in connectors 106a, 117a and respective conductors 118, 119 to a balance assembly including resistors 120, 121 and variable resistor 122. Variable resistor 122 is adjusted to a near zero balanced, at which solenoid switch or relay 85 will be closed to start fan or blower operation when the temperature at sensor 105 is above the temperature at sensor 104 by a small amount, for example, when the temperature at sensor 105 is above the temperature at sensor 104 by one or two degrees Celcius.

Capicitor 125 in conductor 126 is connected between conductors 101, 102, as shown.

Element 130 is an integrated circuit differential amplifier used as a voltage comparator, and serves as means to amplify small voltage differences to large voltage differences to operate the solenoid 131 of relay 85. Terminal "2" of element 130 is connected to conductor 118 by conductor 133. Terminal "3" of element 130 is connected to conductor 119 by conductors 134. Terminal "7" of element 130 is connected to conductor 101 by conductor 135, and terminal "4" of element 130 is connected to conductor 102 by conductor 136, as shown.

Terminal "6" of element 130 is connected through conductor 138 and resistor 139 to the base of transistor 141. Terminal "2" of element 130 is connected through conductor 133 and conductor 142 having resistor 143 to the collector of transistor 141 at conductor 145. Conductor 101 is connected to the emitter of transistor 141, as shown. Solenoid 131 is connected in parallel with rectifier 147. When the voltage difference resulting from element 130 is such that transistor 141 is "on," solenoid 131 is energized to close relay 85, but when the voltage difference is such that transistor 141 is "off," solenoid 131 is not energized and relay 85 is open.

A chassis ground is provided at 150, and conductor 102 is grounded at 151.

Switch 10*a* is very effective in operation, and the temperature difference at which the switch will operate may be readily controlled.

The invention if followed properly can result in more comfortable living area or work area temperatures, and can significantly reduce the use of air conditioners, thereby significantly reducing the consumption and cost of electrical power for air conditioning. An electrically driven fan or blower will operate at a much lower electrical consumption and cost than an air conditioning facility, and so long as the fan or blower will maintain comfortable temperature conditions, the air conditioning facility should not be used if a conservative approach to electrical power utilization and cost is to be followed.

The apparatus herein disclosed operates completely below the temperature range of ordinary ventilator controls. The building or other structure is not allowed to become somewhat overheated before the ventilator commences in operation. Instead, ventilator operation is commenced as soom as its operation would serve to cool the building interior. Ventilator operation should be started when the outside-inside temperature difference is not more than about 10° F. (about 5.5° C.), and preferably ventilator operation should be started when the outside-inside temperature difference is lower, for example about 2° to 3° F. (about 1.1° C. to 1.7° C.), so that no significant heating of the interior can occur before ventilator operation starts. In addition, the invention affords the humidistat control which serves to remove excessive humidity from an attic or other building space when required. This is particularly useful during the winter when sweating within attics and buildings may occur because of high relative humidity.

While preferred embodiments of the apparatus and methods according to the invention have been described and shown in the drawings, many modifications thereof may be made by a person skilled in the art without departing from the spirit of the invention, and it is intended to protect by Letters Patent all forms of the invention falling within the scope of the following claims.

I claim:

1. Apparatus for controlling the operation of electrically driven ventilator means in response to the difference in temperature between first and second locations, comprising an electric switch for controlling operation of said ventilator means, a first temperature responsive diode for sensing the temperature at said first location and a second temperature responsive diode for sensing the temperature at said second location, means for operating said switch in response to temperature differences between said first and second locations to start said ventilator means in operation when the difference in the temperatures between said first and second locations exceeds a small predetermined temperature difference and to stop operation of said ventilator means when the difference in the temperatures between said first and second locations does not exceed said small predetermined temperature difference, said operating means comprising an electrical bridge circuit having first and second input terminals, a direct current electrical source, means connecting said source to said first and second input terminals, said bridge circuit including a pair of parallel branches connected between said first and second input terminals each having an intermediate juncture point and each having a fixed resistor between said juncture point and said first input terminal, said first and second temperature responsive diodes being disposed one in each of said branches between said juncture points and said second input terminal, an integrated circuit differential amplifier serving as a voltage comparator connected between said juncture points and serving to amplify voltage differences caused by temperature differences at said diodes at said first and second locations, a transistor connected to said source and connected to said amplifier to receive the voltage output thereof and being turned on in response to voltage outputs resulting from temperature differences between said first and second locations exceeding said small predetermined temperature difference and being turned off in response to voltage outputs resulting from temperature differences between said first and second locations not exceeding said small predetermined temperature difference, a solenoid in series with said transistor connections to said source adapted to close said switch to turn on said ventilator means when said transistor is turned on and to open said switch to turn off said ventilator means when said transistor is turned off.

2. The combination of claim 1, said bridge circuit including adjustable divided resistor means at said second input terminal for initially balancing the resistances of said temperature responsive diodes.

3. The combination of claim 1, said first location being an interior location and said second location being an exterior location.

* * * * *